US005451191A

United States Patent [19]

Beenken

[11] Patent Number: 5,451,191

[45] Date of Patent: Sep. 19, 1995

[54] FINGER REHABILITATION/EXERCISE DEVICE

[76] Inventor: Gregory M. Beenken, 575 NW. 118th Ave., Plantation, Fla. 33325

[21] Appl. No.: 286,667

[22] Filed: Aug. 5, 1994

[51] Int. Cl.[6] ..... A63B 23/16

[52] U.S. Cl. ..... 482/47; 482/123; 482/908; 601/40

[58] Field of Search ..... 601/40; 602/21, 22; 2/160, 161.1, 161.2; 128/878, 879; 273/188 R, 26 C, 189 R, 189 A; 473/61, 62; 482/44, 47, 48, 49, 121–124, 905, 908

[56] References Cited

U.S. PATENT DOCUMENTS

| | | | |
|---|---|---|---|
| 3,782,719 | 1/1974 | Kuhlman . | |
| 3,871,646 | 3/1975 | Slack . | |
| 4,875,469 | 10/1989 | Broon et al. | 601/40 |
| 4,949,711 | 8/1990 | Gyovai et al. | 602/21 |
| 5,380,259 | 1/1995 | Robertson et al. | 482/123 |

*Primary Examiner*—Richard J. Apley
*Assistant Examiner*—Jeanne M. Clark
*Attorney, Agent, or Firm*—McHale & Slavin

[57] ABSTRACT

The present invention is a finger exercise and rehabilitation device which includes a housing, a pivoting arm-rest hinged at one end to the top of the housing, and a mechanism for pivoting the arm-rest about its hinged end. Each of a plurality of tension cables have one end spring loaded by an elastically deformable member to one of a plurality of possible locations within the housing. Each of the elastically deformable members, such as a coil spring or a length of resilient rubber, exerts a resisting force and stretches when its corresponding cable is pulled during an exercise routine (i.e., when a tensile load is applied). Each of a plurality of finger harnesses is fixed to the other end of each cable and configured to receive one finger of the human hand. A hand positioning block extends out beyond the leading end of the housing. An adjustable hand brace is operatively mounted to the block so as to be longitudinally positionable therealong. The hand brace includes a hand support bar and a mechanism for increasing the distance between the hand bar and the block. Preferably, the hand brace also includes a mechanism for adjusting the pitch of the support bar relative to the block. The ability to adjust the orientation of the support bar relative to the block, and therefore the arm-rest, provides additional versatility in the type of exercise routines possible with the present device.

15 Claims, 3 Drawing Sheets

FINGER REHABILITATION/EXERCISE DEVICE

FIELD OF THE INVENTION

The present invention is related to rehabilitation and exercise equipment for the human hand, and more particularly to a device for rehabilitating and exercising the fingers of a human hand.

BACKGROUND OF THE INVENTION

A wide variety of devices have been developed for exercising and rehabilitating weak or injured hands and fingers, including devices as simple as a rubber ball which is gripped and squeezed in the hand, as well as complex spring loaded cable arrangements. A problem with simple devices like the rubber ball is that the fingers cannot be individually exercised and rehabilitated. In addition, such simple devices do not permit the full range of motion of the fingers. A number of prior spring loaded cable arrangements also limit the range of motion of the fingers during exercising and are otherwise awkward to use. For example, U.S. Pat. Nos. 3,782,719 and 3,871,646 each disclose such a finger exercising device. These two latter devices are intended to remain at a desired location during exercising and rehabilitation. Other such devices are secured in place on a person's hand and forearm giving the person the freedom to walk around while exercising and rehabilitating the fingers and hand. However, it is very time consuming to properly adjust and fit such devices on a person, making their use unpopular especially for those who have only limited periods of time to perform such exercising and rehabilitation.

Therefore, what is needed is a finger exercising and rehabilitation device which permits the fingers of a hand, either individually or collectively, to be exercised through their full range of motion with a limited amount of set-up time.

SUMMARY OF THE INVENTION

An objective of the present invention is to provide a device for exercising and rehabilitating the fingers of a human hand through their full range of motion.

An additional objective of the present invention is to provide a device which permits the fingers of a hand to be individually or collectively exercised and rehabilitated.

Another objective of the present invention is to provide a finger exercise and rehabilitation device which can be utilized without a substantial amount of time being spent in setting-up the device for use.

A further objective of the present invention is to provide a versatile device for exercising and rehabilitating the fingers of a hand that is capable of exercising every finger of the hand including the thumb in every direction of movement.

The above and other objectives of the present invention are obtained by providing a finger exercise and rehabilitation device which includes a housing, a pivoting arm-rest hinged at one end to the top of the housing, and a mechanism for pivoting the arm-rest about its hinged end. Each of a plurality of tension cables have one end spring loaded by an elastically deformable member to one of a plurality of possible locations within the housing. Each of the elastically deformable members, such as a coil spring or a length of resilient rubber, exerts a resisting force and stretches when its corresponding cable is pulled during an exercise routine (i.e., when a tensile load is applied). One of a plurality of finger harnesses is fixed to the other end of each cable and configured to receive one finger of the human hand. Unless otherwise stated, the use of the term finger applies equally to the thumb. A hand positioning block extends out beyond the leading end of the housing. An adjustable hand brace is operatively mounted to the block so as to be longitudinally positionable therealong. The hand brace includes a hand support bar and a mechanism for increasing the distance between the hand bar and the block. Preferably, the hand brace also includes a mechanism for adjusting the pitch of the support bar relative to the block. The ability to adjust the orientation of the support bar relative to the block, and therefore the arm-rest, provides additional versatility in the type of exercise routines possible with the present device.

In a preferred aspect of the present device, each of the tension cables extends through an eyelet that is operatively mounted to the block so as to be longitudinally and transversely positionable thereon. The eyelets help to maintain the relative spacing between each of the tension cables so as not to interfere with movement of the fingers during the exercise and rehabilitation efforts. A pulley mechanism is attached to the hand brace adjacent the hand bar for maintaining each of the tension cables in proper alignment with its corresponding finger, whether the hand is exercised with the palm up or down.

In another preferred aspect of the present invention, a wrist strap is operatively mounted across the block to help maintain the hand in position on the hand support bar during any routine.

Because the arm-rest is pivotable upward and the hand support bar is above the hand positioning block, there is enough room to permit the full range of motion of the fingers.

The above and other objectives, features, and advantages of the present invention will become apparent upon consideration of the detailed description and the appended drawings.

DETAILED DESCRIPTION OF THE INVENTION

Figure 1:
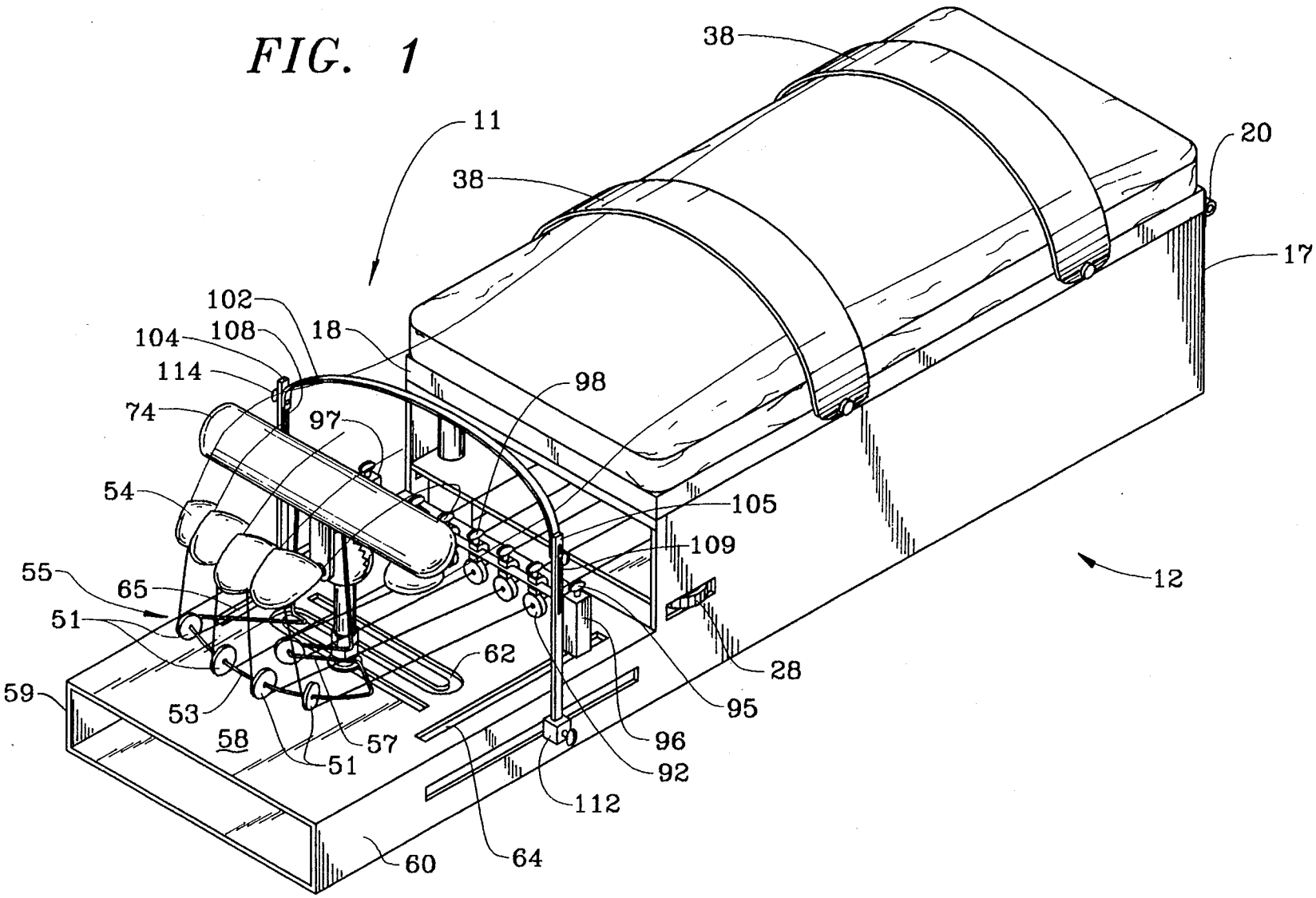
FIG. 1 is a perspective view of the apparatus.
Figure 2:
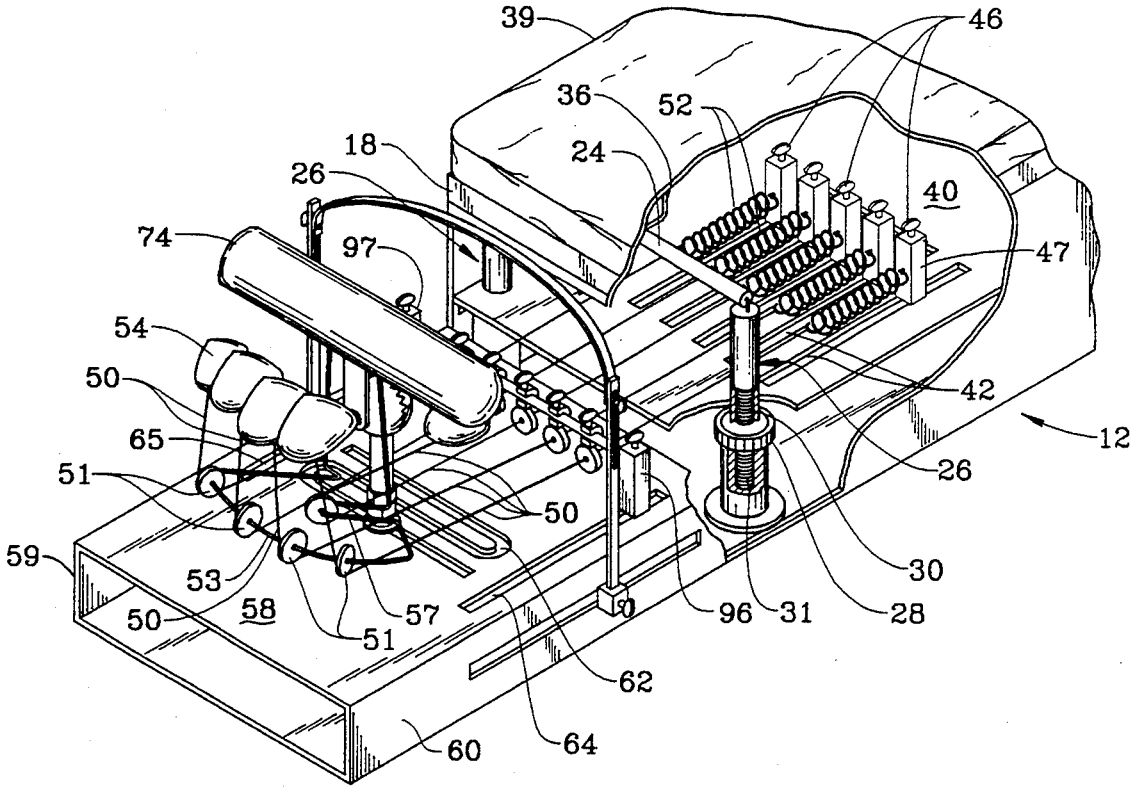
FIG. 2 is a perspective view with a cut-away to illustrate the biasing springs.
Figure 3:
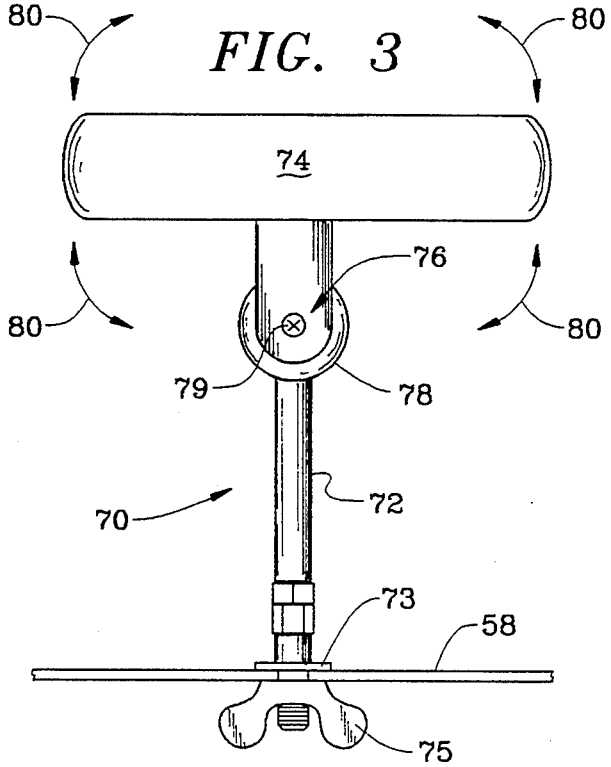
FIG. 3 is an end view of the hand grip.
Figure 4:
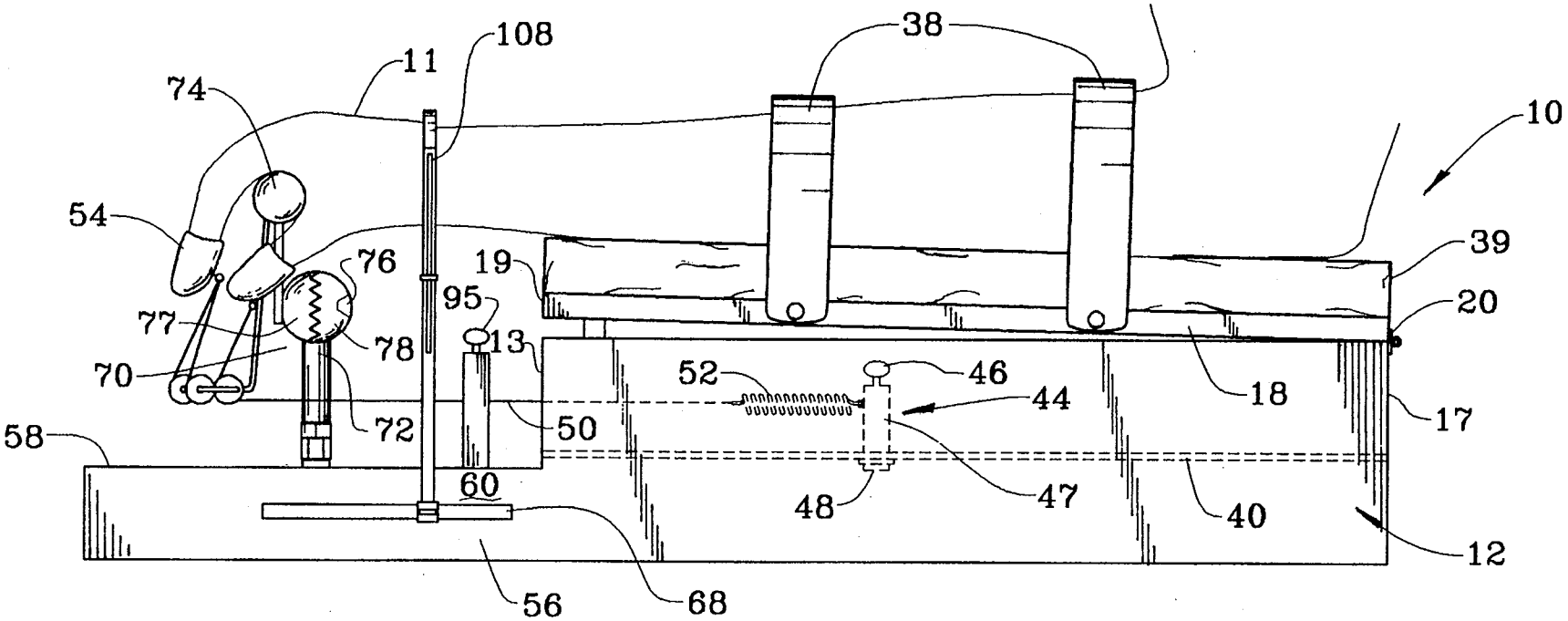
FIG. 4 is a side view of the apparatus; partial top view of FIG. 1 with the arm rest removed.

Although the present invention is herein described in terms of a specific embodiment, it will be readily apparent to those skilled in this art that various modifications, re-arrangements, and substitutions can be made without departing from the spirit of the invention. The scope of the present invention is thus only limited by the claims appended hereto.

Referring to the Figures in general, the perferred embodiment of a device 10 for rehabilitating and exercising the fingers of a human hand 11 (shown in phantom) according to the principles of the present invention includes a housing 12 having a leading end 13 and a rear end 17. A pivoting arm-rest 18, having a pivoting end 19 and a hinged end 20, is mounted on top of the housing 12 with its end 20 hinged to the rear end 17 of housing 12. A mechanism is used to pivot the arm-rest 18 about its hinged end 20. The mechanism is defined by a support roller 24 upon which the pivoting end 19 of the arm-rest 18 is disposed. A pair of adjustable screw-jacks 26, one on either side of the arm-rest 18, are used for adjusting the vertical height of the pivoting end 19. Each of the screw-jacks 26 has a top end mounting one end of the roller 24 and a bottom end mounted to the housing 12. The roller 24 is free to rotate about its longitudinal axis above screw-jacks 26. Each screw-jack 26 also includes an adjustment wheel 28 mounting a shaft therethrough having an upper threaded shaft section 30 and a lower captured shaft section 31. Each upper shaft 30 is disposed within a threaded bore hole formed in an upper section of the screw-jack 26, and each lower shaft 31 is captured and rotatable in a bore formed in a lower section of the screw-jack 26. Thus, clockwise rotation of each wheel 28 causes its respective threaded shaft 30 to back out of the upper section of its screw-jack 26, raising the overall height of each screw-jack 26 and thereby the support roller 24 and the pivoting end 19 of the arm-rest 18. Preferably, the roller 24 is disposed within a guide slot 36 formed through the pivoting end 19 of arm-rest 18. At least one and preferably a plurality of forearm restraining straps 38 are mounted transversely across the pivoting arm-rest 18. Arm-rest 18 preferably includes a cushion 39 for the comfort of the person exercising.

Housing 12 includes a first surface 40 therewithin, disposed between its ends 13 and 17 and spaced below the arm-rest 18. The first surface 40 has five finger adjustment slots 42 formed therethrough, with each slot 42 being laterally spaced apart and running longitudinally between the ends 13 and 17. A first clamp 44 is disposed in and slidable along each of the finger adjustment slots 42. Each clamp 44 is operatively adapted for being alternately fixed in place at variable locations along its corresponding slot 42. For example, each clamp 44 could include a hand tightenable bolt 46 having a shank disposed in a hollow sleeve 47 and a threaded end disposed through its corresponding slot 42 and threaded into a locking nut 48 captured at its end. Sleeve 47 is dimensioned not to pass through slot 42. Thus, by loosening bolt 46, the clamp 44 can be relocated anywhere along its corresponding slot 42, and alternatively fixed in place at such location by simply tightening bolt 46. A cable 50, being one or more strands of a suitable material (e.g., metal wire, nylon cord, etc . . . ), is fixed at one end to each of the first clamps 44. An elastically deformable member 52 (e.g., a tension coil spring, a length of resilient rubber, etc . . . ) interconnects each tension cable 50 to the sleeve 47 of its corresponding finger adjustment clamp 44.

Five finger harnesses 54 are connected one each to the other end of one tension cable 50. Interconnected between the ends of each cable 50 is one of five pulleys 51 mounted on a wire frame 53 forming a pulley mechanism 55. Pulley mechanism 55 will be described in greater detail later. Each finger harness 54 is preferably shaped like one of the finger tips of a glove in order to envelop the tip of the finger being harnessed therein. Each of the harnesses 54 are thus unable to slide along the length of the finger. Having the fingers of the hand 11 harnessed in this glove-like manner provides improved control and helps to ensure that the other end of each cable 50 consistently remains at the same location on the tip of the finger being exercised. With prior devices that used a loop or sling arrangement for its finger harness (see U.S. Pat. No. 3,782,719), the sling-type harness could slide along the finger, thereby changing the load mechanics of the exercise (i.e., varying the degree of difficulty of the exercise), unintentionally in the middle of a routine. Controlling the difficulty level of the exercise can be crucial to the effectiveness of the exercise and rehabilitation effort. Any such change in the routine being followed can disrupt this effort.

The other end of each cable 50 extends through an opening formed at the leading end 13 of housing 12 and out over a hand positioning block 56. The extent to which each harness 54 extends out beyond the leading end 13 of housing 12 is, as previously discussed, dependent upon the placement of its corresponding clamp 44. The hand positioning block 56 is an integral part of housing 12 and firmly fixed to the leading end 13 thereof. Block 56 has a top surface 58 and two side surfaces 59 and 60 extending out beyond the leading end 13 of housing 12. The top surface 58 is level with and preferably disposed below the first surface 40 of housing 12. The top surface 58 has a S-shaped slot 62 and two cable guide adjustment slots 64 and 65 formed therethrough. Slots 64 and 65 are transversely spaced apart with each running longitudinally on either side of the S-shaped slot 62. Each of the side surfaces 59 and 60 has a wrist retention adjustment slot 68 formed therethrough and running longitudinally generally parallel to slots 64 and 65.

During an exercise/rehabilitation routine, the hand 11 braces against an adjustable pitched hand brace 70 mounted above the block 56. The hand brace 70 includes a vertically adjustable first support post 72 mounting a hand support bar 74 upon which the hand 11 is braced. The bottom end of the first support post 72 is mounted in and lockable in place anywhere along the S-shaped slot 62 by any conventional means, such as with a washer 73 fixed to post 72 and a wing nut 75 threaded onto the bottom end of post 72. The washer 73 is disposed above and the wing nut 75 below the top surface 58. Hand bar 74 is thereby positionable to, both transversely and longitudinally, and fixable at multiple locations on top surface 58, as needed to preform a given exercise or rehabilitation routine. The pitch or angle of the support bar 74 relative to the first support post 72, or surface 58, is adjustable by use of a pivot screw assembly 76 or any other suitable means interconnecting the first post 72 and hand bar 74. Pivot screw assembly 76 has a first and second half 77 and 78. Halves 77 and 78 have opposing mating surfaces, such as with matching ribs and grooves, which can be engaged by sufficiently tightening and disengaged by sufficiently loosening a screw 79 passing through halve 78 and threaded into halve 77. Halve 78 is fixed to the top end of first post 72 and halve 77 mounts hand bar 74. Rotation of hand bar 74, as depicted by arrows 80 to preform a given exercise or rehabilitation routine, is effected by loosening screw 79, pivoting bar 74 to a desired angular relation and then tightening screw 79. The length of the first support post 72, and thereby the height of the hand bar 74 above top surface 58, is also adjustable by any conventional means, such as a locking nut assembly is defined by dividing post 72 into an upper and a lower section, with a shaft having a threaded end threadably disposed in one section of post 72, its other end captured but rotatable in the other section of post 72, and a pair of locking nuts threadably disposed along that portion of the threaded end extending out of the other section of post 72.

A cable guide assembly is mounted to the top surface 58 of block 56 to orient each of the cables 50 in whatever relationship facilitates the exercise or rehabilitation procedure being preformed by the fingers of hand 11. Cable guide assembly is defined by an eyelet 92 for each cable 50, a guide bar 94 and two second support post 96 and 97. Each eyelet 92 is operatively adapted to permit the passage of one cable 50 therethrough, and is mounted to and positionable along the guide bar 94 by a second clamp 98, which is similar to the hand tightenable first clamp 44 and therefore not described in further detail herein. The ends of guide bar 94 are each mounted to the top of one of the second posts 96 and 97 also with a hand tightenable screw clamp 95. The bottom end of each second post 96, 97 is mounted in and positionable along one of the longitudinal slots 64 and 65, respectively, in a manner similar to that described above for post 72 and S-slot 62. The length of slots 64 and 65 permit positioning of the posts 96 and 97 between the hand brace 70 and the leading end 13 of housing 12, as well as out beyond hand brace 70. In addition, pulley mechanism 55 is mounted to the hand brace 70 so as to maintain its relative orientation to the hand bar 74 as the pitch of bar 74 is adjusted. For example, pulley mechanism 55 could be mounted to hand bar 74 or pivot screw assembly half 77. Preferably, mechanism 55 is mounted so as to pivot up and down between bar 74 and block 56. A thumb section 57 of wire frame 53 is operatively adapted to pivot independently from the balance of frame 53 to accommodate the change in position of the thumb as the pitch of hand bar 74 is changed. Thus, each of the cables 50 can be oriented to a wide variety of locations above block 56 and relative to brace 70, as needed to preform a given exercise or rehabilitation routine.

To help the hand 11 remain in proper position relative to the hand bar 74 during a finger exercise or rehabilitation routine, a wrist retention assembly may be used and is defined by a wrist strap 102 and two third support posts 104 and 105. Each support post 104 and 105 has an upper end with a respective strap adjustment slot 108 and 109 formed therethrough. The lower end of each support post 104 and 105 is mounted in and positionable along one of the wrist retention adjustment slots 68 and 69, respectively, by a third clamp 112, similar to clamp 44. Each end of strap 102 is fixed to a fourth clamp 114 mounted in and positionable along its respective slot 108 and 109 on the ends of posts 104 and 105. Clamps 114 are also similar to clamps 44. Slots 68 and 69 run almost the full length of block 56. Thus, the wrist retention assembly can be positioned on either side of hand brace 70 as needed to preform a given exercise or rehabilitation routine. The vertical adjustability of strap 102 afforded by clamps 114 and slots 108, 109 also enables strap 102 to be brought into proper position regardless of the vertical location of hand bar 74 or the inclination of arm-rest 18.

Thus, the present device 10 can be adjusted by hand, as previously described, to custom fit the hand 11 of any user for performing a given routine. Individual adjustments made for a given hand 11 or routine are preferably noted in order to reduce the time necessary for any subsequent customizing to a user. A plurality of graduated lines (not shown) may be strategically located along each of the above slots 42, 62, 64, 65, 68, 69, 108, and 109 as well as guide bar 94 in order to facilitate such adjustments. With the device 10 so adjusted, the exercise/rehabilitation routine can be readily performed and repeated periodically with minimal set-up time.

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. A device for rehabilitating and exercising the fingers of a human hand comprising: a housing having a longitudinal length, a leading end and a rear end; a pivoting arm rest having a pivoting end and a hinged end, said arm rest being mounted on top of said housing with said hinged end being hinged to the rear end of said housing; means for lifting said pivoting end to provide an angular slope to said arm rest about said hinged end; a plurality of tension cables, each of said cables having a proximal end fixed through an elastically deformable member to an adjustable cable clamp located within said housing and a distal end extending beyond the leading end of said housing; a plurality of finger harnesses, each said harness coupled to one of said distal ends of said cable clamps and configured to receive one finger of the human hand; a hand positioning block having a length extending out beyond the leading end of said housing; and an adjustable pitch hand brace including a hand support bar operatively mounted perpendicular to the longitudinal length of said housing with an adjustable ratchet mount for adjusting the pitch of said support bar relative to said block and a support post coupled to said ratchet mount and said hand positioning block having a means for adjusting the height of said support bar relative to said block.

2. The device of claim 1 further comprising a cable guide assembly including a plurality of eyelets, each eyelet having one of said cables extending therethrough and being operatively mounted to said block so as to guide each said cable through said leading end of said housing.

3. The device of claim 1 further comprising a wrist retention assembly including a wrist strap having a length and two ends and being operatively mounted across said block so as to be longitudinally positionable therealong.

4. The device of claim 1, said housing containing a first surface disposed between its leading end and rear end, said first surface having a plurality of spaced finger adjustment slots formed therethrough, each of said finger adjustment slots running longitudinally between said leading end and said rear end, each of said first clamps being disposed in and slidable along one of said finger adjustment slots.

5. The device of claim 1, said means for pivoting said arm-rest including a support roller having two roller ends with the pivoting end of said arm-rest disposed thereon and at least one jack-mounting said support roller for adjusting the vertical height of said pivoting end.

6. The device of claim 1, each of said finger harnesses being configured to envelop the tip of one finger.

7. The device of claim 1, said hand positioning block having a top surface with a S-shaped slot formed therethrough, and said adjustable pitch hand brace including a lock nut located along one end of said hand brace support post for securely positioning said hand bracket along said S-shaped slot.

8. The device of claim 1 including a pulley mechanism having a wire frame coupled to said support bar for mounting a plurality of pulleys above the surface of said hand positioning block, each pulley being operatively interconnected between the ends of one of said cables to optimize any forces applied to one corresponding finger harness during an exercise.

9. The device of claim 8, said pulley mechanism being mounted to said hand brace so as to maintain its relative orientation to said hand bar as the pitch of said hand bar is adjusted.

10. A device for rehabilitating and exercising the fingers of a human hand comprising:

a housing having a leading end and a rear end;

an arm rest being mounted on top of said housing with one end hinged to said rear end;

a mechanism for pivoting said arm-rest relative to said housing;

a plurality of tension cables, each of said cables having proximal end operatively adapted for being fixed to a plurality of longitudinal locations within said housing through an elastically deformable member;

a plurality of finger harnesses, each of said harnesses being fixed to a distal end of one of said cables and adapted to receive one finger of the human hand;

a hand positioning block having a length extending out beyond the leading end of said housing; and an adjustable hand brace including a hand support bar operatively mounted perpendicular to the longitudinal length of said housing.

11. The device of claim 10, said adjustable hand brace including an extension means for adjusting the height of said support bar above said block.

12. The device of claim 10, the one end of each of said cables being fixed to a plurality of longitudinal locations along a surface within said housing, and said hand positioning block having a top surface being level with or below the surface of said housing.

13. The device of claim 10 including a pulley mechanism having a wire frame coupled to said support bar for mounting a plurality of pulleys above the surface of said hand positioning block, each pulley being operatively interconnected between the ends of one of said cables to optimize any forces applied to one corresponding finger harness during an exercise.

14. The device of claim 13, said pulley mechanism being mounted to said hand brace so as to maintain its relative orientation to said hand bar as the pitch of said hand bar is adjusted.

15. A device for rehabilitating and exercising the fingers of a human hand comprising:

a housing having a leading end, a rear end and a first surface disposed therebetween, said first surface having a plurality of spaced finger adjustment slots formed therethrough, each of said finger adjustment slots running longitudinally between said leading end and said rear end;

a pivoting arm rest having a pivoting end and a hinged end, said arm rest being mounted on top of said housing with said hinged end being hinged to the rear end of said housing;

a mechanism for pivoting said arm rest about said hinged end including a support roller having two roller ends with the pivoting end of said arm rest disposed thereon, a pair of adjustable screw jacks one on either side of said arm rest for adjusting the vertical height of said pivoting end, each of said screw jacks having a top end mounting one of said roller ends and a bottom end mounted to said housing;

at least one forearm retaining strap mounted transversely across said pivoting arm rest;

a plurality of first clamps, each first clamp being disposed in and slidable along one of said finger adjustment slots and being operatively adapted for slidable adjustment along its corresponding slot;

a plurality of tension cables, each cable having one end fixed to one of said first clamps through an elastically deformable member and a distal end extending beyond the leading end of said housing;

a plurality of finger harnesses, each harness being fixed to the other end of one of said cables and configured to envelop the tip of one finger;

a hand positioning block having a top surface and two side surfaces extending out beyond the leading end of said housing, said top surface being below said arm rest and having formed therethrough a S-shaped slot located between two transversely spaced second longitudinal slots, and each of said side surfaces having a third longitudinal slot formed therethrough;

an adjustable pitch hand brace having a vertically adjustable first support post with a length, a first top end and a first bottom end, and a hand support bar mounted to the first top end of said first support post, said first bottom end being slidably securable to said S-shaped slot, with a pivot means for adjusting the pitch of said support bar relative to said first support post and an extension means for adjusting the length of said first support post and thereby the height of said support bar from the top surface of said hand positioning block;

a pulley mechanism having a wire frame mounting a plurality of pulleys, each pulley being operatively interconnected between the ends of one of said cables to optimize any forces applied to one corresponding finger harness during an exercise, said pulley mechanism being mounted to said hand brace so as to maintain its relative orientation to said hand bar as the pitch of said hand bar is adjusted;

a cable guide assembly including a plurality of eyelets, each eyelet having one of said cables extending therethrough, a guide bar having a length and two ends and two second support posts, each second support post having a top end and a bottom end with said eyelets being adjustably mounted to said guide bar by a second clamp, each end of said guide bar being mounted to the top end of one of said second support posts, the bottom end of each of said second support posts disposed between said hand brace and the leading end of said housing and slidably securable to one of said second longitudinal slots; and a wrist retention assembly including an adjustable wrist strap having a length and two ends and two third support posts, each third support post having an upper end and a lower end disposed between said hand brace and the leading end of said housing and slidably secured to one of said third longitudinal slots.

* * * * *